United States Patent [19]

Sugimoto

[11] 4,033,553

[45] July 5, 1977

[54] DOUBLE-DRUM WINCH

[75] Inventor: Yutaka Sugimoto, Hiratsuka, Japan

[73] Assignee: Kabushiki Kaisha Komatsu Seisakusho, Tokyo, Japan

[22] Filed: June 26, 1975

[21] Appl. No.: 590,569

[52] U.S. Cl. ..... 254/185 B; 192/4 R

[51] Int. Cl.[2] ..... B66D 1/26

[58] Field of Search ..... 254/185 B, 185 R, 184, 254/183; 212/55, 39 A; 192/4 R, 18 A

[56] References Cited

UNITED STATES PATENTS

| | | | |
|---|---|---|---|
| 2,179,082 | 11/1939 | Benson | 254/185 B |
| 2,445,116 | 7/1948 | Huston | 254/185 B |
| 2,954,209 | 9/1960 | Luketa | 254/185 R |
| 3,578,787 | 5/1971 | Brickett et al. | 254/185 R |
| 3,722,707 | 3/1973 | Hedeen et al. | 254/185 R |
| 3,733,812 | 5/1973 | Lawrence | 254/185 R |
| 3,895,699 | 7/1975 | Mita et al. | 254/185 B |

*Primary Examiner*—L. J. Paperner
*Assistant Examiner*—Kenneth Noland
*Attorney, Agent, or Firm*—Armstrong, Nikaido & Marmelstein

[57] ABSTRACT

Double-drum winch has a hook drum for actuating a hook through a hook wire wound around the hook drum and a boom drum for actuating a boom which supports the hook through a boom wire wound around the boom drum each rotatably mounted on a drum shaft, a first and a second planetary gear system each adapted to drive the hook drum and the boom drum by the drum shaft, respectively, a hook clutch for driving the hook drum through the first planetary gear system by the drum shaft when engaged and a hook brake for arresting the hook drum when engaged, a boom clutch for driving the boom drum through the second planetary gear system by the drum shaft when engaged and a boom brake for arresting the boom drum when engaged, a clutch mechanism including a forward driving connection clutch for driving the drum shaft in the forward direction, a reverse driving connection clutch for driving the drum shaft in the reverse direction and a plurality of different speed clutches for driving the drum shaft at different speeds. The hook drum and the boom drum can be actuated independently from each other in either of the forward and reverse directions at any of the different speeds by the selected operation of one or more of three manually controlled systems.

2 Claims, 2 Drawing Figures

DOUBLE-DRUM WINCH

BACKGROUND OF THE INVENTION

The present invention relates primarily to a double drum winch for use with a side crane in a construction machine, and more particularly, to a double drum winch of the type described above in which a hook drum for actuating the hook of the winch apparatus and a boom drum for actuating the boom means supporting the hook are actuated independently from each other.

Heretofore, a double drum winch apparatus has been developed for actuating the hook and the boom means supporting the hook. In the prior art double drum winch, however, the so-called horizontal retraction or horizontal extension of the hook i.e., the operation by which the hook is moved downwardly or upwardly by the actuation of one of the drums or the hook drum while, at the same time, the boom means is actuated upwardly or downwardly by the actuation of the other drum or the boom drum, can not be effected, because the two drums can not be actuated independently from each other, thereby extremely limiting the range of the kinds of operations of the winch. Further, in the prior art winch, a number of operating levers are provided for the various operations of the winch thereby requiring skill of the operator while tending to cause false function of the winch and early fatigue of the operator.

The present invention aims at avoiding the disadvantages of the prior art winch as described above.

SUMMARY OF THE INVENTION

The object of the present invention is to provide a novel and useful double-drum winch which avoids the above described disadvantages of the prior art winch and in which the drums can be actuated independently from each other by the selective operation of very few number of manual levers thereby permitting the range of kinds of operations of the winch to be broadened while the manipulation of the winch is made easy without causing any false function thereof.

The above object is achieved in accordance with the present invention by the provision of a double-drum winch having a power source, a clutch mechanism with its input connected to the power source and consisting of a forward driving connection clutch, a reverse driving connection clutch and speed changing clutches, a speed reduction pulley-chain mechanism with its input connected to the output of the clutch mechanism, a drum shaft connected to the output of the speed reduction pulley-chain mechanism, a hook drum rotatably mounted on the drum shaft and adapted to wind up or unwind a hook through a hook wire wound around the hook drum and a boom drum rotatably mounted on the drum shaft and adapted to lift or descend boom means supporting the hook through a boom wire wound around the boom drum, the winch being characterized by a first planetary gear system mounted on the drum shaft with its sun gear secured to the drum shaft while the planetary pinion gears mounted on a rotatable carrier and meshing with the sun gear are engaged with the hook drum so as to drive the hook drum through the first planetary gear system by the drum shaft, a second planetary gear system mounted on the drum shaft with its sun gear secured to the drum shaft while the planetary pinion gears mounted on a rotatable carrier and meshing with the sun gear are engaged with the boom drum so as to drive the boom drum through the second planetary gear system by the drum shaft, a hook clutch arranged so as to engage and disengage the carrier of the first planetary gear system with and from a stationary portion of the winch thereby permitting the hook drum to be driven by the drum shaft when the hook clutch is engaged, a boom clutch arranged so as to engage and disengage the carrier of the second planetary gear system with and from a stationary portion of the winch thereby permitting the boom drum to be driven by the drum shaft when the boom clutch is engaged, a hook brake adapted to arrest the rotation of the hook drum when engaged, a boom brake adapted to arrest the rotation of the boom drum when engaged, a first hydraulic control system for actuating the hook clutch, the hook brake, the forward driving connection clutch and the reverse driving connection clutch so as to wind up or unwind the hook, a first manually operable means coupled with the first hydraulic control system for actuating the same, a second hydraulic control system for actuating the boom clutch, the boom brake, the forward driving connection clutch and the reverse driving connection clutch so as to lift or descend the boom means, a second manually operable means coupled with the second hydraulic control system for actuating the same, a third hydraulic control system for actuating the speed changing clutches so as to vary the speed of the output of the clutch mechanism and a third manually operable means coupled with the third hydraulic control system for actuating the same, thereby permitting the winding up or unwinding of the hook, the lifting or descending of the boom means and the speed changing of the clutch mechanism to be selectively and independently effected by the selective operation of any one or more of the first to third manually operatable means.

In accordance with the characteristic feature of the present invention the first hydraulic control system comprises a hook clutch actuating valve connected to the hook clutch and coupled with the first manually operable means so as to effect the engagement and disengagement of the hook clutch by the actuation of the first manually operable means, a hook brake actuating valve connected to the hook brake so as to effect the engagement and disengagement of the hook brake, a forward driving connection clutch actuating valve connected to the forward driving connection clutch so as to effect the engagement and disengagement of the forward driving connection clutch and a reverse driving connection clutch actuating valve connected to the reverse driving connection clutch so as to effect the engagement and disengagement of the reverse driving connection clutch, the first manually operable means being further operably coupled with the hook brake actuating valve, the forward driving connection clutch actuating valve and the reverse driving connection clutch actuating valve so that, when the hook clutch is engaged by the actuation of the first manually operable means, the hook brake is disengaged while either one of the forward driving connection clutch and the reverse driving connection clutch is engaged and the other is disengaged by the selected operation of the first manually operable means, the second hydraulic control system comprising a boom clutch actuating valve connected to the boom clutch and coupled with the second manually operable means so as to effect the engagement and disengagement of the boom clutch by the actuation of the second manually operable means, a boom brake actuating valve connected to the boom brake so as to effect the engagement and disengagement of the boom brake, the forward driving connection clutch actuating valve, and the reverse driving connection clutch actuating valve, the second manually operable means being further operably coupled with the boom brake actuating valve, the forward driving connection clutch actuating valve and the reverse driving connection clutch actuating valve so that, when the boom clutch is engaged by the actuation of the second manually operable means, the boom brake is disengaged while either one of the forward driving connection clutch and the reverse driving connection clutch is engaged and the other is disengaged by the selected operation of the second manually operable means, the third hydraulic control system comprising a multiposition switching valve connected to each of the speed changing clutches and coupled with the third manually operable means, thereby permitting the speed of the output of the clutch mechanism to be changed by switching the multiposition switching valve to a selected position thereof for actuating the selected one of the speed changing clutches.

The provision of the planetary gear systems permits the capacity of the hook and boom clutches to be greatly reduced, because the force required to arrest the carriers of the planetary gear system is lowered.

DETAILED DESCRIPTION OF THE PREFERRED EMBODIMENT

Figure 1:
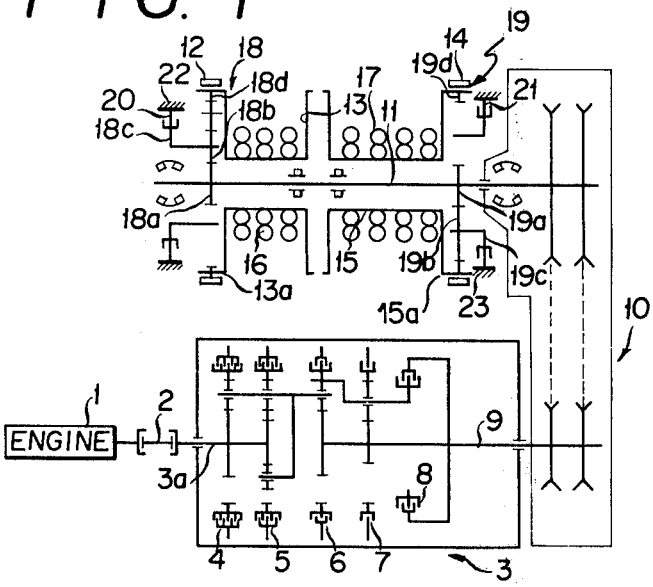
FIG. 1 is a schematic sectional view showing an embodiment of the double-drum winch constructed in accordance with the present invention.

Referring to FIG. 1, the power source 1 such as an engine of a construction machine or vehicle (not shown) is connected to the input shaft 3*a* of a transmission or clutch mechanism 3 through a universal joint 2. The transmission or the clutch mechanism 3 is a hydraulically operated clutch and includes a forward driving connection clutch 4, a reverse driving connection clutch 5, a first speed clutch 6, a second speed clutch 7 and a third speed clutch 8, thus the output shaft 9 of the clutch mechanism 3 can be driven in the forward direction at three different speeds and in the reverse direction at three different speed by variously switching the connection of the clutches 4 to 8.

The output shaft 9 is connected to a drum shaft 11 through a speed reduction pulley-chain mechanism 10. The drum shaft is journaled by self-aligning spherical ball bearings mounted in the winch.

A hook drum 15 is rotatably supported by bearings on the drum shaft 11 and is provided with a cylindrical peripheral flange 15*a* having an internal gear at the inner peripheral surface thereof.

A hook wire 17 is secured at one end to the hook drum 15 and wound therearound so that a hook (not shown) attached to the other end can be moved upwardly or wound up, or moved downwardly or unwound depending upon in which of the forward and reverse directions the hook drum is rotated.

In the similar manner, a boom drum 13 is rotatably supported by bearings on the drum shaft 11 and is provided with a Cylindrical peripheral flange 13*a* having an internal gear at the inner peripheral surface thereof.

A boom wire 16 is secured at one end to the boom drum 13 and wound therearound so that boom means (not shown) of the winch connected to the other end of the boom wire 16 is lifted or descended depending upon in which of the forward and reverse direction the boom drum 13 is rotated.

The hook wire 17 is stretched around pulley means mounted on the boom means so that the hook is moved upwardly or downwardly by the operation of the hook drum 15 while the hook is outwardly extended or inwardly retracted by the actuation of the boom caused by the rotation of the boom drum 13 in the reverse or forward direction.

A first planetary gear system 19 is provided between the drum shaft 11 and the cylindrical peripheral flange 15*a* of the hook drum 15 with its sun gear 19*a* secured to the drum shaft 11 while the planetary pinion gears 19*b* rotatably mounted on a rotatable carrier 19*c* and meshing with the sun gear 19*a* are engaged with the internal gear 19*d* forward in the cylindrical peripheral flange 15*a* of the hook drum 15. A hook clutch 21 is provided between the carrier 19*c* of the planetary gear system 19 and a stationary portion 23 of the winch apparatus so that, when the clutch 21 is engaged, the hook drum 15 is driven through the planetary gear system 19 by the drum shaft 11.

A hook brake 14 is arranged around the cylindrical peripheral flange 15*a* so that, when the brake 14 is engaged, the rotation of the hook drum 15 is arrested.

In the similar manner, a second planetary gear system 18 is arranged between the drum shaft 11 and the cylindrical peripheral flange 13*a* of the boom drum 13 with its sun gear 18*a* secured to the drum shaft 11 while the planetary pinion gears 18*b* rotatably mounted on a rotatable carrier 18*c* and meshing with the sun gear 18*a* are engaged with the internal gear 18*d* formed in the cylindrical peripheral flange 13*a* of the boom drum 13. A boom clutch 20 is arranged between the carrier 18*c* of the second planetary gear system 18 and a stationary portion 22 of the winch apparatus so that the boom drum 13 is rotated by the drum shaft 11 when the boom clutch 20 is engaged.

A boom brake 12 is arranged around the cylindrical peripheral flange 13*a* of the boom drum 13 so that, when the brake 12 is engaged, the rotation of the boom drum 13 is arrested.

Figure 2:
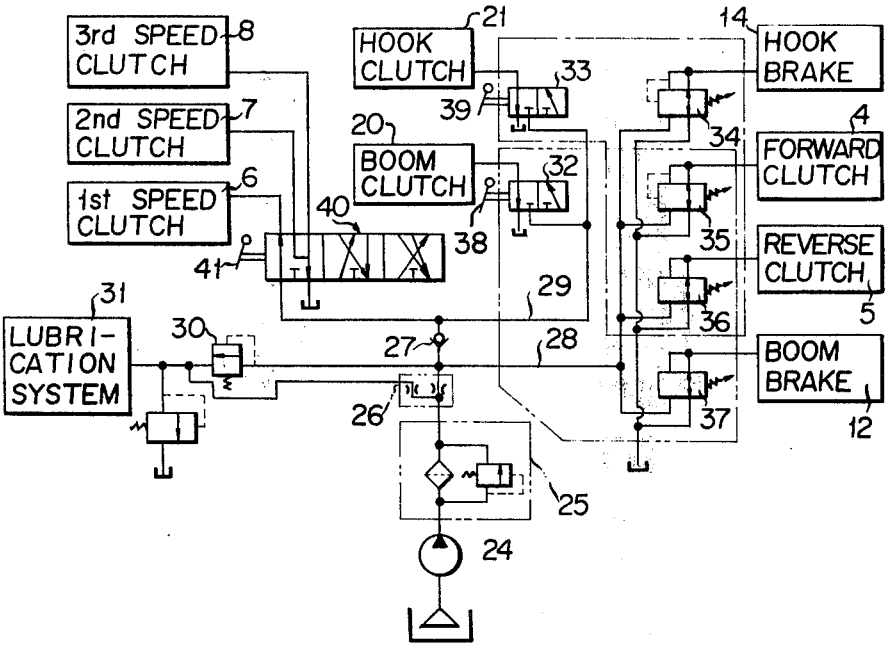
FIG. 2 is a block diagram showing the hydraulic control circuit of the winch shown in FIG. 1.

FIG. 2 shows a hydraulic control circuit of the present invention for hydraulically controlling the respective clutches and brakes for the various operations of the winch shown in FIG. 1.

The pressurized working fluid supplied from the supply source through a pump 24 is supplied to a first fluid passage 28 through a filter 25 and a flow divider 26 and through a check valve 27 to a second fluid passage 29. The first fluid passage leads on one hand to a spring biased hook brake actuating valve 34 for actuating the hook brake 14, a spring biased forward driving connection clutch actuating valve 35 for actuating the forward driving connection clutch 4, a spring biased reverse driving connection clutch actuating valve 36 for actuating the reverse driving connection clutch 5 and a spring biased boom brake actuating valve 37 for actuating the boom brake 12 while the first fluid passage 28 on the other hand leads to a lubrication system 31 of the winch through a pressure regulating valve 30.

The second fluid passage 29 leads on one hand to a manually operated hook clutch actuating valve 33 coupled with a first manually operable lever 39 and hydraulically connected to the hook clutch 21 and a manually operated boom clutch actuating valve 32 coupled with a second manually operable lever 38 and hydraulically connected to the boom clutch 20, while, on the other hand, the second fluid passage 29 leads to a three position switching valve 40 to which the first speed clutch 6, the second speed clutch 7 and the third speed clutch 8 of the transmission or the clutch mechanism 3 are connected while a third manually operable lever 41 is coupled with the valve 40 for manually switching the same.

The first manually operable lever 39 is further coupled with the valves 34, 35 and 36 by linkage means (not shown) so as to constitute a first hydraulic control system together with the valve 33 for actuating the hook drum 15 in various modes of operation as described later.

The second manually operable lever 38 is further coupled with the valves 35, 36 and 37 so as to constitute a second hydraulic control system together with the valve 32 for actuating the boom drum 13 in various modes of operation as described later.

The valve 40 manually operated by the third manually operable lever 41 constitutes a third hydraulic control system for varying the speed of the output shaft 9 of the clutch mechanism 3.

Following Table 1 shows the positions of various clutches and brakes as set by the force of the biasing spring or in the working fluid pressure.

Table 1

Positions of Clutches and Brakes Set by Spring and Fluid Pressure in Hook and Boom Operating Valve Systems.

| | Engage | Disengage |
|---|---|---|
| Hook Brake(14) | Spring | Fluid Pressure |
| Boom Brake(12) | Spring | Fluid Pressure |
| Forward Driving Connection Clutch(4) | Fluid Pressure | Spring |
| Reverse Driving Connection Clutch(5) | Fluid Pressure | Spring |
| Hook Clutch(21) | Fluid Pressure | Spring |
| Boom Clutch(22) | Fluid Pressure | Spring |
| First Speed Clutch(6) | Fluid Pressure | Spring |
| Second Speed Clutch(7) | Fluid Pressure | Spring |
| Third Speed Clutch(8) | Fluid Pressure | Spring |

As shown in Table 1, the hook brake 14 and the boom brake 12 are disengaged when the fluid pressure is applied, whereas all the clutches 4, 5, 21, 22, 6, 7 and 8 are engaged when the fluid pressure is applied.

The positions of the brakes and the clutches in various modes of operation of the winch as described above are shown in the following Table 2.

Table 2

Positions of Brakes and Clutches in Various Operations of Hook & Boom.

| Operation | | Clutches | | | | Brakes | |
|---|---|---|---|---|---|---|---|
| Hook (17) | Boom (16) | Forward (4) | Reverse (5) | Hook (21) | Boom (20) | Hook (14) | Boom (12) |
| Wind Up | Lift | Engage | Dis-engage | Engage | Engage | Dis-engage | Dis-engage |
| Unwind | Decend | Dis-engage | Engage | Engage | Engage | Dis-engage | Dis-engage |
| Wind Up | Free Fall | Engage | Dis-engage | Engage | Dis-engage | Dis-engage | Dis-engage |
| Free Fall | Lift | Engage | Dis-engage | Dis-engage | Engage | Dis-engage | Dis-engage |
| Stop | Lift | Engage | Dis-engage | Dis-engage | Engage | Engage | Dis-engage |
| Stop | Decend | Dis-engage | Engage | Dis-engage | Engage | Engage | Dis-engage |
| Wind Up | Stop | Engage | Dis-engage | Engage | Dis-engage | Dis-engage | Engage |
| Unwind | Stop | Dis-engage | Engage | Engage | Dis-engage | Dis-engage | Engage |
| Stop | Stop | Dis-engage | Dis-engage | Dis-engage | Dis-engage | Engage | Engage |

Thus, when the hook and the boom are to be simultaneously moved upwardly, for example, both the first and second manually operable levers 39 and 38 are so actuated that both the hook clutch 21 and the boom clutch 20 are engaged and the forward driving connection clutch 4 is engaged so as to drive the output shaft 9 in the forward direction, while the remaining clutch 5, the hook brake 14 and the boom brake 12 are disengaged or released.

When the hook is to be horizontally moved, the hook is set in the free fall position (freely descended by the gravity) and the boom is set in the lifting position, i.e., only the forward driving connection clutch 4 and the boom clutch 20 are engaged while the remaining clutches and brakes are disengaged. Alternatively, the boom is set in the free fall position while the hook is moved upwardly so as to effect the horizontal driving of the hook.

In Table 2, "unwind" of the hook and "descend" of the boom designate the forced driving of the respective element by the power applied thereto.

It is apparent that the unwind and descend can be effected by engaging the reverse driving connection clutch 5 instead of the forward driving connection clutch 4 by the selected actuation of the lever 39 and/or the lever 38, while the speed change of the drum shaft 11 is effected by the selected operation of the lever 41.

As described above, the present invention provides a double-drum winch in which the hook drum and the boom drum can be independently driven in either of the forward and the reverse direction at selected different speed by the selected actuation of only three manually operable levers thereby permitting the operation of the winch to be effected easily without causing any false function and the fatigue of the operator while the range of various modes of operation of the winch is broadened without requiring a number of complicated lever mechanism heretofore required thereby permitting the construction of the winch to be made simple.

Further, since the first and the second planetary gear systems 19, 18 are provided so as to drive the hook and boom drums 15 and 13 through the clutches 21, 20, respectively, the torque required in the clutches is extremely reduced thereby permitting the capacity of the clutches to be reduced:

I claim:

1. Double-drum winch having a power source, a clutch mechanism with its input connected to said power source and comprising a forward driving connection clutch, a reverse driving connection clutch and speed changing clutches, a speed reduction means with its input connected to the output of said clutch mechanisms, a drum shaft connected to the output of said speed reduction means, a hook drum rotatably mounted on said drum shaft and adapted to wind up or unwind a hook through a hook wire wound around said hook drum and a boom drum rotatably mounted on said drum shaft and adapted to lift or descend boom means supporting said hook through a boom wire wound around said boom drum, wherein the improvement comprises a first planetary gear system mounted on said drum shaft with its sun gear secured to said drum shaft, planetary pinion gears mounted on a rotatable carrier, meshing with said sun gear and engaged with said hook drum so as to drive said hook drum through said first planetary gear system by said drum shaft, a second planetary gear system mounted on the other end of said drum shaft with its sun gear secured to said drum shaft, planetary pinion gears mounted on a rotatable carrier, meshing with said sun gear and engaged with said boom drum so as to drive said boom drum through said second planetary gear system by said drum shaft, a hook clutch arranged so as to engage and disengage said carrier of said first planetary gear system with and from a stationary portion of said winch thereby permitting said hook drum to be driven by said drum shaft when said hook clutch is engaged, a boom clutch arranged so as to engage and disengage said carrier of said second planetary gear system with and from a stationary portion of said winch thereby permitting said boom drum to be driven by said drum shaft when said boom clutch is engaged, a hook brake adapted to arrest the rotation of said hook drum when engaged, a boom brake adapted to arrest the rotation of said boom drum when engaged, a first hydraulic control system for actuating said hook clutch, said hook brake, said forward driving connection clutch and said reverse driving connection clutch so as to wind up or unwind said hook, a first manually operable means coupled with said first hydraulic control system for actuating the same, a second hydraulic control system for actuating said boom clutch, said boom brake, said forward driving connection clutch and said reverse driving connection clutch so as to lift or descend said boom means, a second manually operable means coupled with said second hydraulic control system for actuating the same, a third hydraulic control system for actuating said speed changing clutches so as to vary the speed of the output of said clutch mechanism and a third manually operable means coupled with said third hydraulic control system for actuating the same, thereby permitting the winding up or unwinding of said hook, the lifting or descending of said boom means and the speed changing of said clutch mechanism to be selectively and independently effected by the selective operation of any one or more of said first to third manually operable means.

2. Double-drum winch according to claim 1, wherein said first hydraulic control system comprises a hook clutch actuating valve connected to said hook clutch and coupled with said first manually operable means so as to effect the engagement and disengagement of said hook clutch by the actuation of said first manually operable means, a hook brake actuating valve connected to said hook brake so as to effect the engagement and disengagement of said hook brake, a forward driving connection clutch actuating valve connected to said forward driving connection clutch so as to effect the engagement and disengagement of said forward driving connection clutch and a reverse driving connection clutch actuating valve connected to said reverse driving connection clutch so as to effect the engagement and disengagement of said reverse driving connection clutch, said first manually operable means being further operably coupled with said hook brake actuating valve, said forward driving connection clutch actuating valve and said reverse driving connection clutch actuating valve so that, when said hook clutch is engaged by the actuation of said first manually operable means, said hook brake is disengaged while either one of said forward driving connection clutch and said reverse driving connection clutch is engaged and the other is disengaged by the selected operation of said first manually operable means, said second hydraulic control system comprising a boom clutch actuating valve connected to said boom clutch and coupled with said second manually operable means so as to effect the engagement and disengagement of said boom clutch by the actuation of said second manually operable means, a boom brake actuating valve connected to said boom brake so as to effect the engagement and disengagement of said boom brake, said forward driving connection clutch actuating valve and said reverse driving connection clutch actuating valve, said second manually operable means being further operably coupled with said boom brake actuating valve, said forward driving connection clutch actuating valve and said reverse driving connection clutch actuating valve so that, when said boom clutch is engaged by the actuation of said second manually operable means, said boom brake is disengaged while either one of said forward driving connection clutch and said reverse driving connection clutch is engaged and the other is disengaged by the selected operation of said second manually operable means, said third hydraulic control system comprising a multiposition switching valve connected to each of said speed changing clutches and coupled with said third manually operable means, thereby permitting the speed of the output of said clutch mechanism to be changed by switching said multiposition switching valve to a selected position thereof for actuating the selected one of said speed changing clutches.

* * * * *